US008186539B2

(12) United States Patent
Lin

(10) Patent No.: US 8,186,539 B2
(45) Date of Patent: May 29, 2012

(54) TRASH BIN

(76) Inventor: Tsong-Yow Lin, Taichung Hsien (TW)

( * ) Notice: Subject to any disclaimer, the term of this patent is extended or adjusted under 35 U.S.C. 154(b) by 176 days.

(21) Appl. No.: 12/650,631

(22) Filed: Dec. 31, 2009

(65) Prior Publication Data

US 2011/0155755 A1 Jun. 30, 2011

(51) Int. Cl.

| | |
|---|---|
| ***B65D 43/14*** | (2006.01) |
| ***B65D 51/04*** | (2006.01) |
| ***B65D 43/22*** | (2006.01) |
| ***B65D 43/24*** | (2006.01) |
| ***B65D 43/26*** | (2006.01) |

(52) U.S. Cl. ..... 220/830; 220/263; 220/264; 220/810; 220/908

(58) Field of Classification Search ..... 220/810, 220/263, 264, 830, 908
See application file for complete search history.

(56) References Cited

U.S. PATENT DOCUMENTS

| | | | | |
|---|---|---|---|---|
| 6,857,538 | B2 | 2/2005 | Lin | 220/830 |
| 2004/0159661 | A1* | 8/2004 | Aochi | 220/264 |
| 2007/0089273 | A1* | 4/2007 | Kang | 16/330 |
| 2008/0067083 | A1* | 3/2008 | Lin | 206/139 |

* cited by examiner

*Primary Examiner* — Anthony Stashick
*Assistant Examiner* — Andrew T Kirsch

(57) ABSTRACT

A cover device for a trash bin includes a base member, which has a first end and a second end. A compartment is formed at the first end and an opening is defined between the first and second ends of the base member through which trash can be thrown into the trash bin. A cover member includes a cover portion and a connected element. At least one elastic device includes an elastic element having a first end provided at the compartment and a second end coupled to the connected element. The cover member can be rotated between a first position and a second position. While in the second position of the cover member, the elastic element is released to lift the cover member upward, with the cover portion being completely exposed from the base member outward.

16 Claims, 8 Drawing Sheets

TRASH BIN

BACKGROUND OF THE INVENTION

1. Field of the Invention

The present invention relates to a trash bin.

2. Description of the Related Art

U.S. Pat. No. 6,857,538 discloses a cover assembly including a ring mounted on a garbage bin, a cover mounted on the ring and a slow pivot device for slowly pivoting the cover relative to the ring. The slow pivot device includes a slow pivot element installed between the ring and the cover. The slow pivot element includes an internal tube, an external tube enclosing the internal tube and a spring connected between the internal tube and the external tube.

Thus, rotation of the internal tube relative to the external tube exerts a torque on the spring. The spring is received in the internal tube so that an end thereof is connected with the internal tube. The internal tube is received in the external tube so that an end thereof is connected with the external tube. The internal tube is received in the external tube so that the other end of the spring is connected with the external tube. The internal tube includes a clip formed on an internal side thereof for clipping an end of the spring. The external tube includes a clip formed on an internal side thereof for clipping an opposite end of the spring.

However, while the cover is opened with respect to the ring, the slow pivot element is exposed outward from the cover and the ring. The exposed slow pivot element gets dirty easily by dust or trash. Long-time-use of the garbage bin reflects a performance effect of the slow pivot element so that the garbage bin may easily be broken.

SUMMARY OF THE INVENTION

Accordingly, the object is achieved by providing a trash bin. The trash bin comprises a barrel and a cover device. The cover device includes a base member, a cover member and an elastic device.

A connected element of the cover member covers the elastic device and a secure base installed to the cover member so that dust and trash would not be in contact with the elastic device and the secure base.

While the cover member is pivoted with respect to the base member, a cover portion of the cover member is completely out of the base member so that an opening of the base member is completely exposed outward without any cover.

Other advantages and features of the present invention will become apparent from the following descriptions referring to the drawings.

BRIEF DESCRIPTION OF THE DRAWINGS

The present invention will be described through detailed illustration of the preferred embodiment referring to the drawings.

DETAILED DESCRIPTION OF THE PREFERRED EMBODIMENTS

Figure 1:
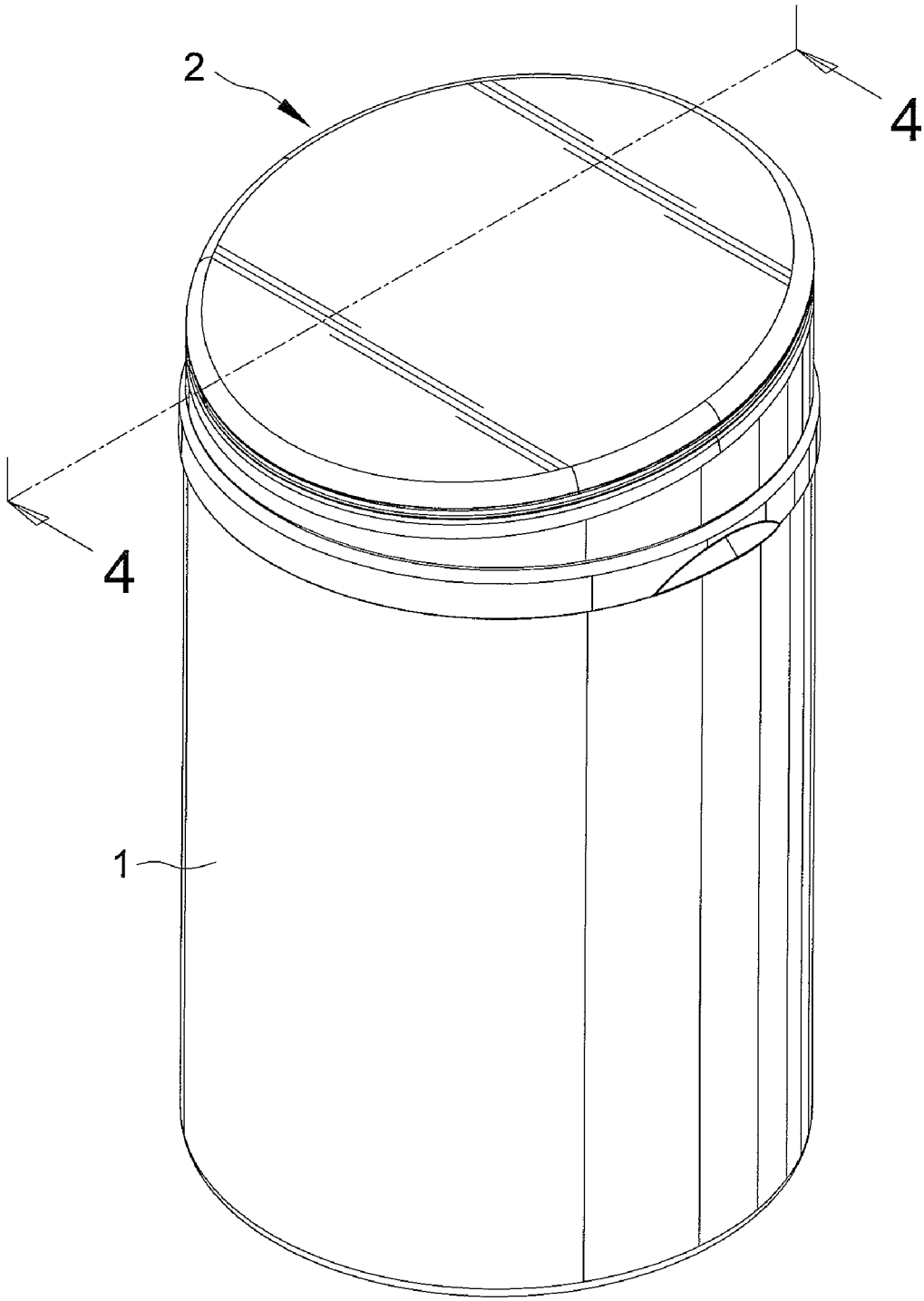
FIG. 1 is a perspective view of a trash bin according to the preferred embodiment of the present invention, illustrating the cover member in the first position.
Figure 2:
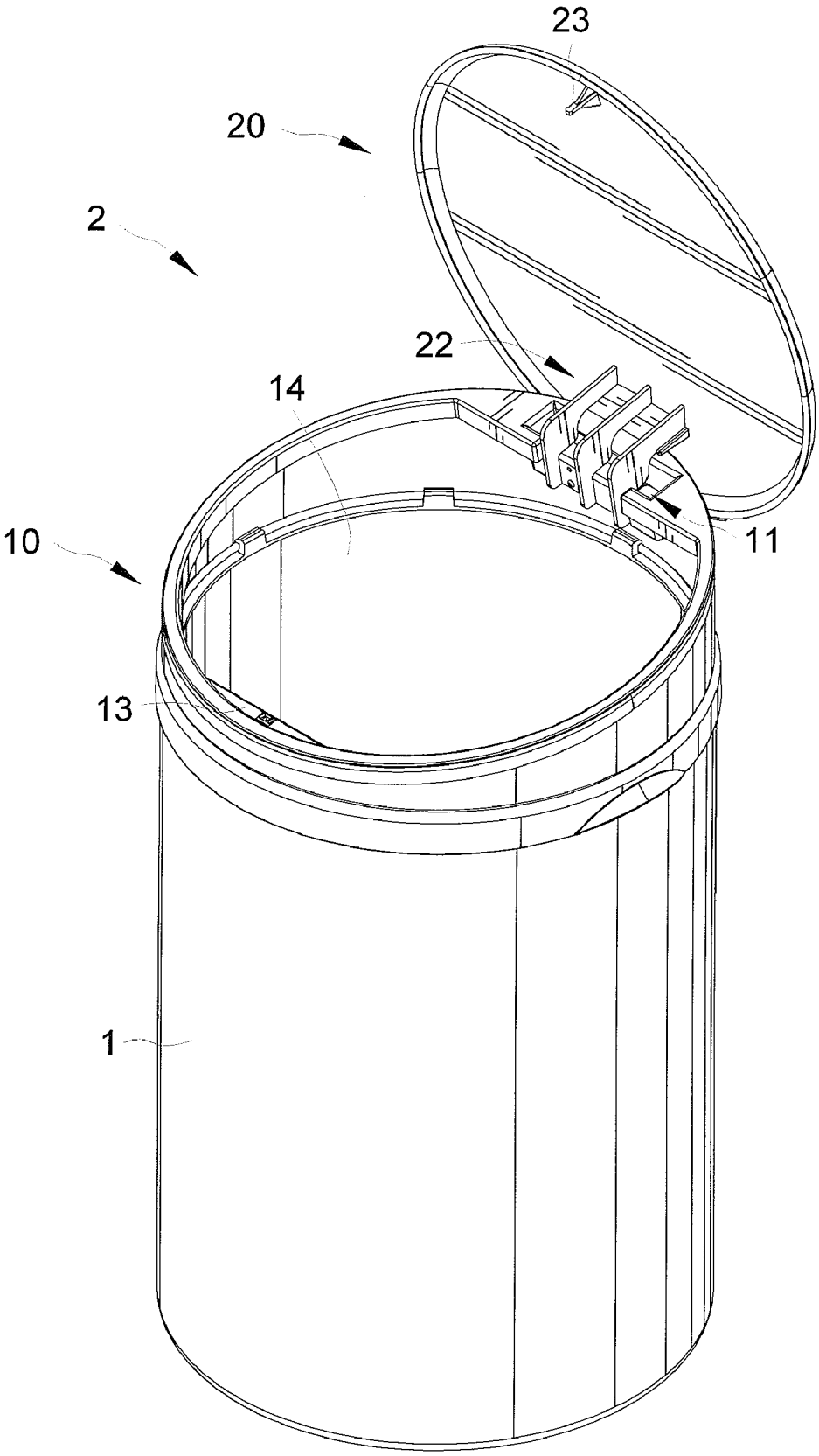
FIG. 2 is another perspective view of the trash bin shown in FIG. 1, illustrating the cover member opened with respect to the base member and in the second position.

FIGS. 1 through 5 show a trash bin including a barrel 1 and a cover device 2 mounted onto the barrel 1. The cover device 2 includes a base member 10 installed to the barrel 1 and a cover member 20 pivotally connected to the base member 10. The cover member 20 is able to be lifted with respect to the base member 10 and is provided at the outer periphery of the base member 10, so that while dropping litter, the cover member 20 would not be a barricade. At least one elastic device 30 is provided at the cover device 2 and connects the base member 10 to the cover member 20 for lifting the cover member 20 with respect to the base member 10.

The base member 10, which has a first end 101 and a second end 102, includes a compartment 11 and at least one fixed block 12. In this case, the amount of the fixed blocks 12 is two. The compartment 11 includes a bottom wall 111 defined on the bottom thereof, two lateral walls 112 defined on two sides thereof and spaced from each other, a rear wall 113, a front wall 114 opposite to the rear wall 113 and a top wall 115 opposite to the bottom wall 111. A limited hole 1121 is formed on each lateral wall 112 and in the form of a polygonal hole. A gap 116 is formed at the center of the bottom wall 111 and extends to the center of the front wall 114.

The fixed block 12 is fixed to the bottom wall 111 and is surrounded between the bottom, lateral, rear and front walls 111, 112, 113 and 114 to restrict the fixed block 12 from detaching from the compartment 11 easily. A stepped hole 121 is axially formed on the fixed block 12 and corresponds to the limited hole 1121.

A tongue element 13 is provided at the second end 102 of the base member 10 and is formed with a hooked hole 131. An opening 14 is formed through the base member 10 between the first and second ends 101, 102 and communicates with the gap 116. Trash can be thrown into the barrel 1 of the trash bin from the opening 14.

The cover member 20 includes a cover portion 21 having a first end 211 and a second end 212, a connected element 22 fixed to the first end 211 of the cover portion 21, a secure base 23 provided at the connected element 22 and a hook 24 provided at the second end 212 of the cover portion 21 and selectively hooking at the hooked hole 131. The cover portion 21 selectively covers the opening 14 for closing the trash bin.

The connected element 22 is approximately L-shaped and is able to rotate with respect to the gap 116. A first section 221 of the connected element 22 is fixed to the first end 211 of the cover member 20 and is approximately perpendicular to the cover portion 21. A second section 222 of the connected element 22, which is provided at the gap 116 and coupled to the first section 221 opposite to the cover member 20, is approximately parallel to the cover member 20. An outer periphery 223 and an inner periphery 224 are defined on the connected element 22 between the first and second sections 221, 222. The outer periphery 223 is toward the second section 222 of the connected element 22, and the inner periphery 224 is toward the first section 221 of the connected element 22.

The secure base 23 is fixed to the second section 222 of the connected element 22 and is located on the inner periphery 224. The outer periphery 223 is adapted to cover the secure base 23, so that the secure base 23 would not be exposed outward. A polygonal restricted hole 231 is formed axially through the secure base 23.

The elastic device 30 includes a first tube member 31 inserted into the stepped hole 121 of the fixed block 12, a second tube member 32 and an elastic element 33. The first tube member 31 includes an engaged end 311 and an engaged hole 312 respectively formed on two ends thereof. The engaged end 311 is engaged with the limited hole 1121 of the related lateral wall 112 so that the first tube member 31 can not rotate with respect to the base member 10.

The second tube member 32 is provided between the stepped hole 121 of the fixed block 12 and the restricted hole 231 of the secure base 23 and includes a limited end 321 and an engaged hole 322 respectively formed on two ends thereof. The limited end 321 has a cross-section which is in the form of a polygon and is inserted into the restricted hole 231 of the secure base 23 so that the second tube member 32 can not rotate with respect to the secure base 23.

The elastic element 33 has a first end 331 engaged with the engaged hole 312 of the first tube member 31 and a second end 332 engaged with the engaged hole 322 of the second tube member 32. While the first and second tube members 31, 32 are rotated with respect to each other, the elastic element 33 is driven to twist for providing a torque.

The cover member 20 is able to pivot between a first position and a second position. While in the first position of the cover member 20, the hook 24 hooks at the base member 10, the first end 331 of the elastic element 33 is engaged with the first tube member 31 and the second end 332 of the elastic element 33 is engaged with the second tube member 32 and twists with respect to the first end 331.

Figure 3:
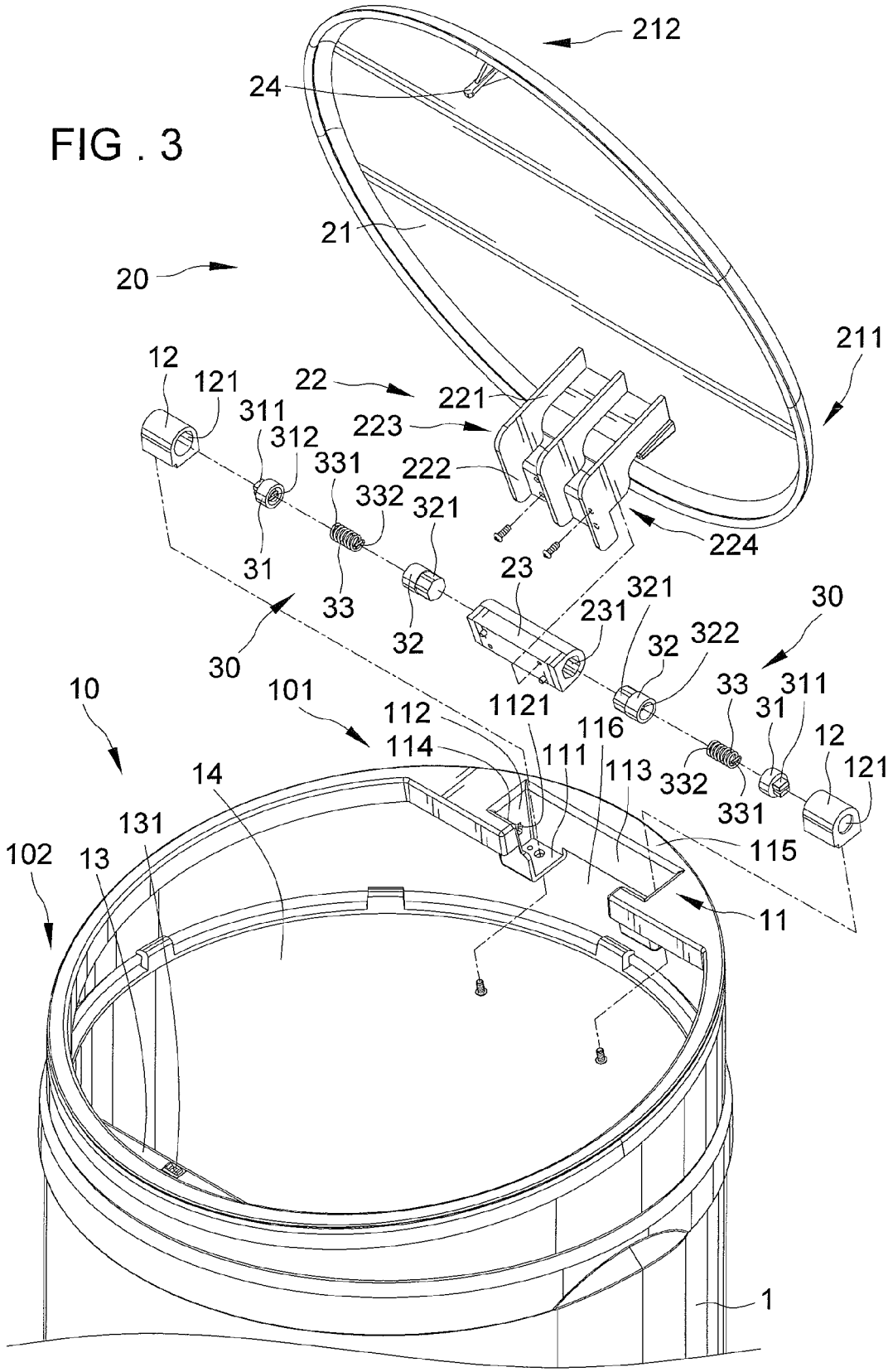
FIG. 3 is a partial, exploded perspective view of the trash bin shown in FIG. 1.
Figure 4:
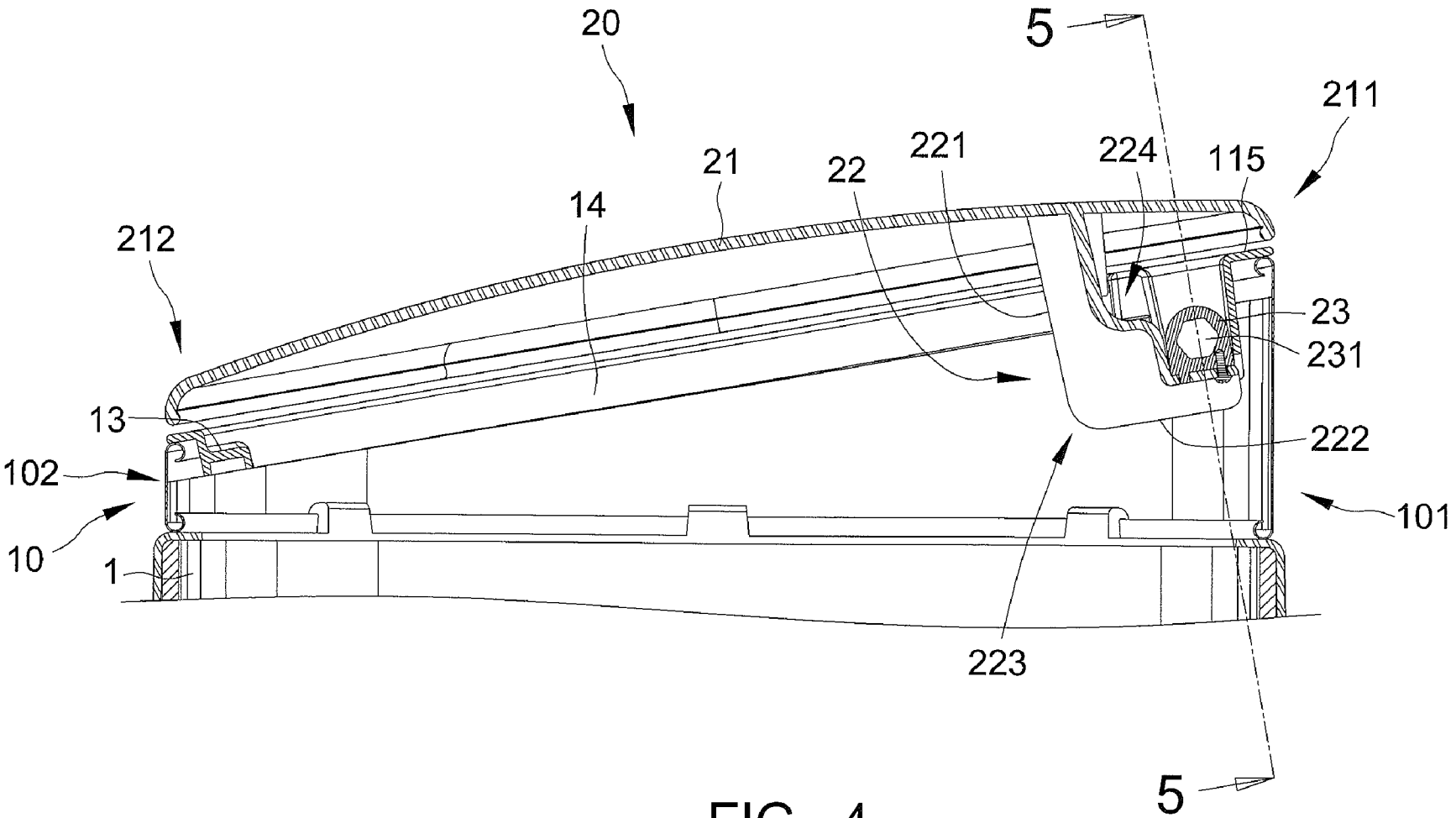
FIG. 4 is a cross-sectional view taken along line 4-4 in FIG. 1.
Figure 5:
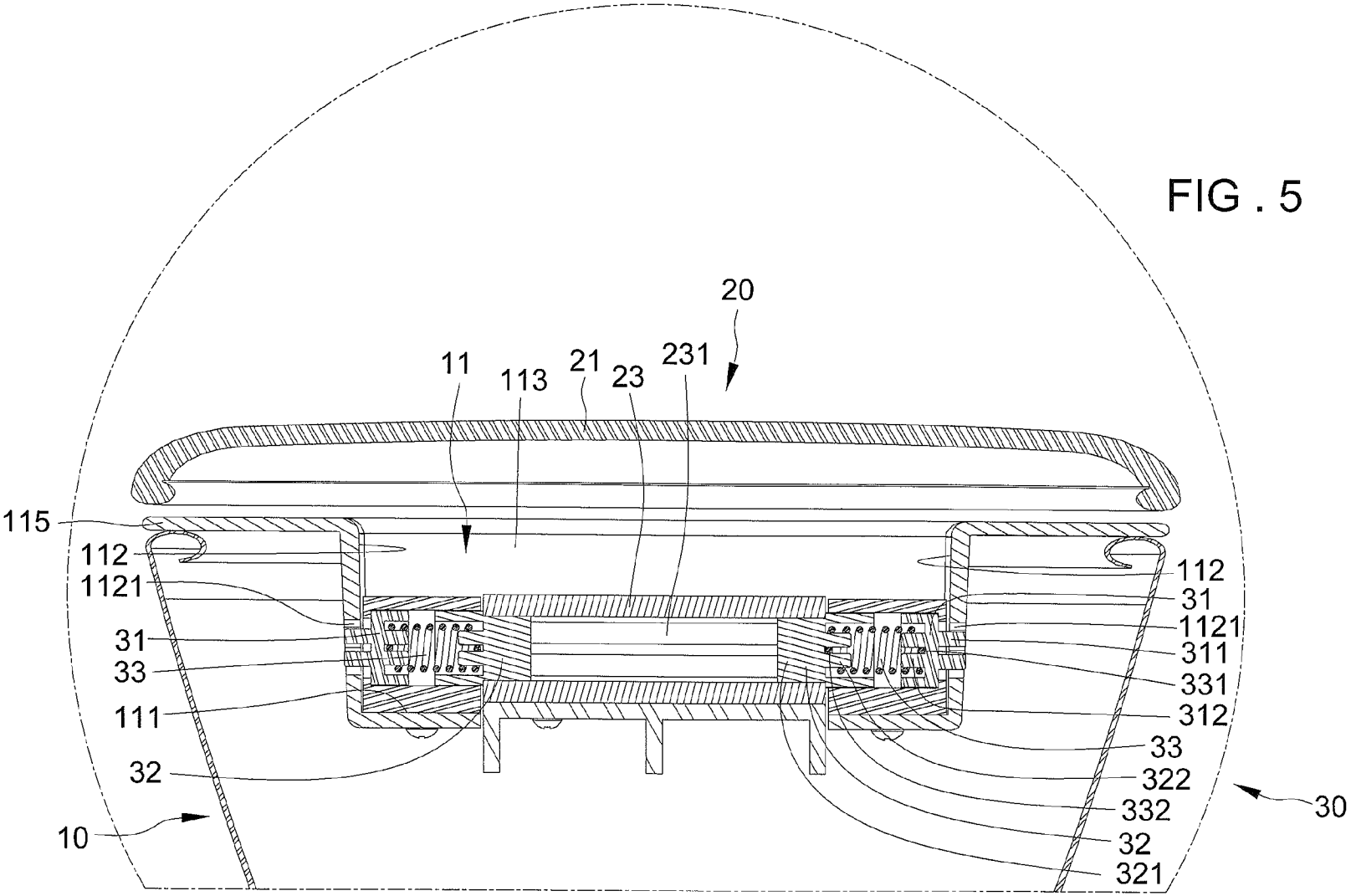
FIG. 5 is a cross-sectional view taken along line 5-5 in FIG. 4.
Figure 6:
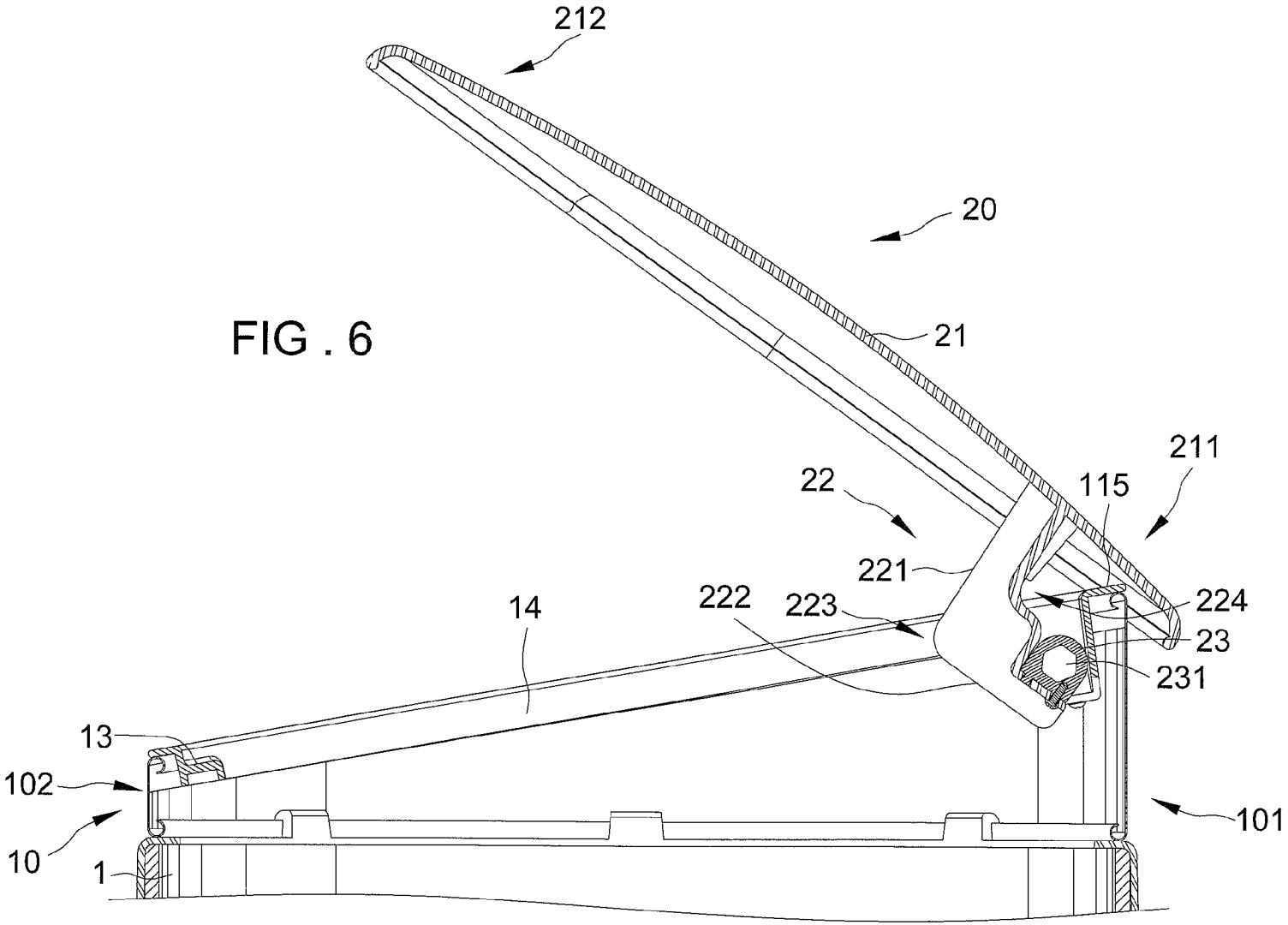
FIG. 6 is another cross-sectional view similar to FIG. 4, but illustrating the cover member lifted from the base member.
Figure 7:
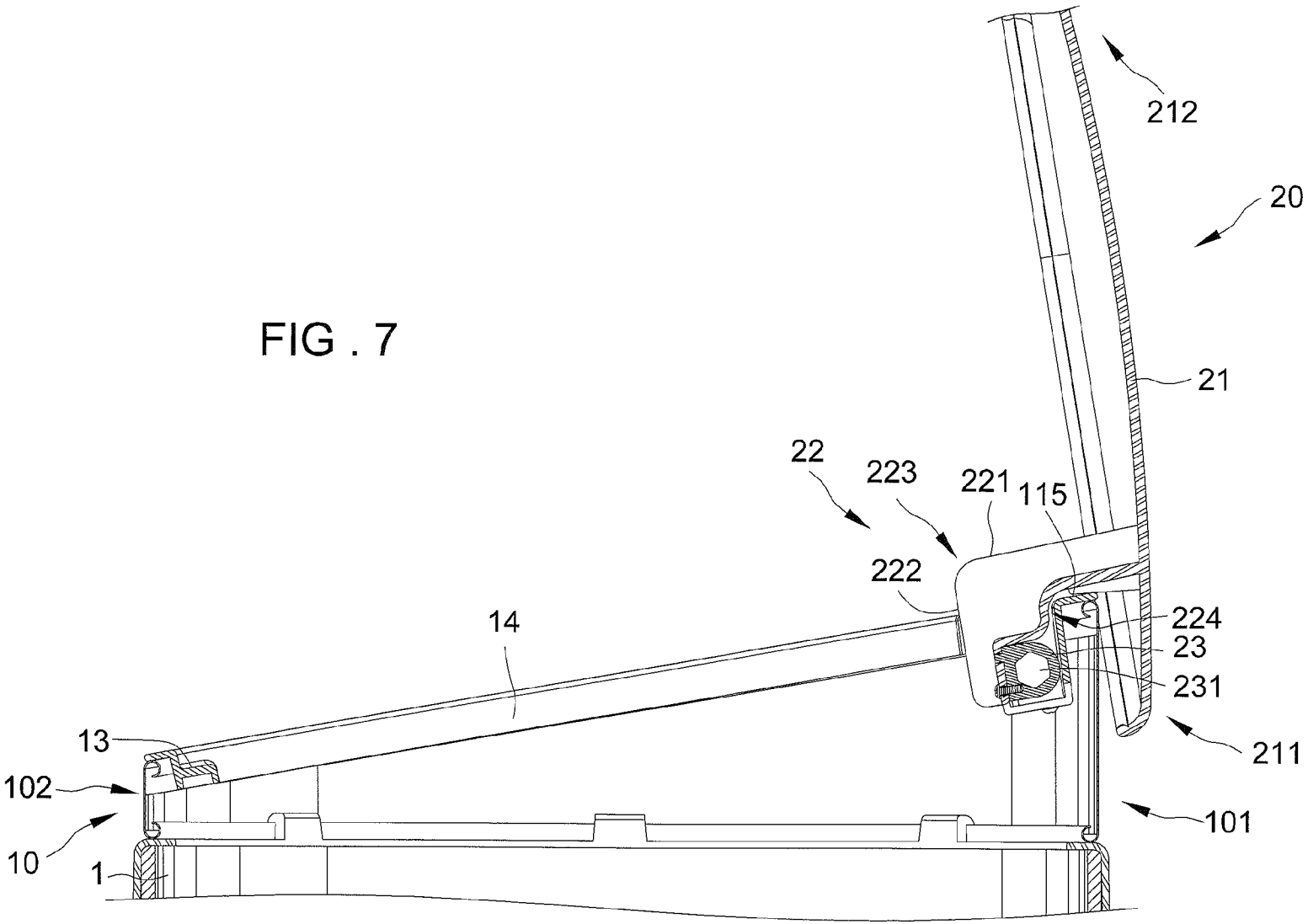
FIG. 7 is another cross-sectional view similar to FIG. 6, but illustrating the cover member in the second position.
Figure 8:
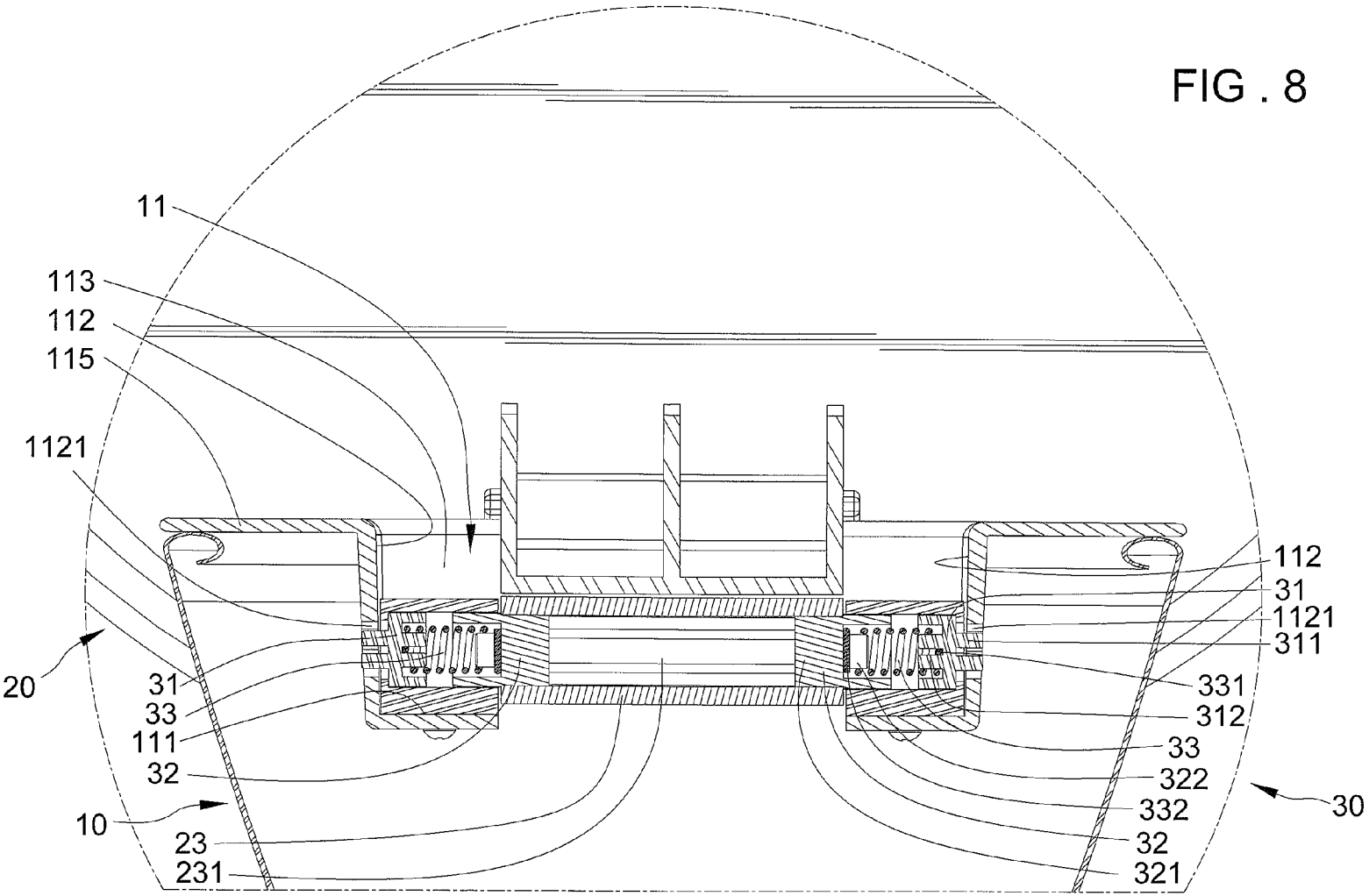
FIG. 8 is another cross-sectional view similar to FIG. 5, but illustrating the cover member in the second position.

Referring to FIGS. 6 through 8, a user presses the second end 212 of the cover portion 21 downward to disengage the hook 24 from the hooked hole 131 (shown in FIG. 3). Then, the cover member 20 is lifted with respect to the base member 10 via the elastic device 30. In the meanwhile, the elastic element 33 is released, and the second end 332 twists with respect to the first end 331 to drive the second tube member 32 to rotate with respect to the first tube member 31 and drives the secure base 23 to rotate. Further, the secure base 23 drives the cover member 20 to lift to the second position, and the first section 221 of the connected element 22 presses against the top wall 115 so that the cover member 20 is supported by a cooperation of the top wall 115 and the first section 221 of the connected element 22. Hence, the cover member 20 is securely positioned in the second position without sway and would not close automatically.

Simultaneously, the outer periphery 223 of the connected element 22 is exposed outward and covers the secure base 23 and the elastic device 30 so that dust and trash would not be in contact with the base 23 and the elastic device 30 for preventing the trash bin from being broken easily.

While in the second position of the cover member 20 and since the connected element 22 extends outward from the base member 10, a connection of the cover portion 21 and the base member 10 is out of the base member 10. However, the secure base 23 is located inside of the base member 10. The cover portion 21 is completely out of the base member 10 so that the opening 14 is opened without any cover.

While several embodiments of the invention have been shown and described, it will be apparent to those skilled in the art that modifications may be made therein without departing from the scope and spirit of the present invention.

What is claimed is:

1. A cover device for a trash bin comprising:

a base member including a compartment formed at a first end thereof and an opening to throw trash into the trash bin from the opening, with the opening having a periphery;

a cover member including a cover portion and a connected element, with the cover portion having a periphery, with the connected element including a first section fixed to the cover portion and a second section integrally coupled to the first section and extending from the first section spaced from the cover portion and towards the periphery of the cover portion, with the first section being spaced from the periphery of the cover portion;

at least one elastic device, with each elastic device including an elastic element having a first end provided at the compartment and a second end coupled to the connected element; and wherein the cover member is rotatable about an axis defined through the first and second ends of the elastic device between a first position and a second position, with the axis being spaced from the first section and the periphery of the cover portion; wherein while in the first position of the cover member, the peripheries of the opening and the cover portion abut with the opening of the base member closed by the cover portion of the cover member and the elastic element is pressed to twist with respect to the cover member; and wherein while in the second position of the cover member, the elastic element is released to lift the cover member upward, with the periphery of the cover portion being completely exposed and spaced from the periphery of the opening of the base member outward in the second position.

2. The cover device as claimed in claim 1 wherein while in the second position of the cover member, the connected element covers the at least one elastic device.

3. The cover device as claimed in claim 1, further comprising a tongue element provided at the second end of the base member and having a hooked hole thereon and a hook installed to an end of the cover member opposite to the connected element, with the hooked hole and the hook hooked to each other.

4. The cover device as claimed in claim 1, wherein the connected element is of a generally L-shape.

5. The cover device as claimed in claim 4 further comprising at least one fixed block provided at the compartment and a secure base connected to the second section of the connected element spaced from the cover portion; wherein the elastic device further includes a first tube member inserted into the at least one fixed block and engaged with the compartment and a second tube member inserted into the secure base and not able to rotate with respect to the secure base, with the elastic element having a first end coupled to the first tube member and a second end coupled to the second tube member.

6. The cover device as claimed in claim 5, wherein the connected element further forms an outer periphery and an inner periphery between the first and second sections, with the secure base fixed to the second section of the connected element and located on the inner periphery of the connected element, with the outer periphery of the connected element covering the secure base.

7. The cover device as claimed in claim 5 further comprising a restricted hole formed axially through the secure base; wherein the second tube member includes a limited end and an engaged hole respectively defined at two ends thereof, with the limited end inserted into the restricted hole of the secure base, with the second tube member not being able to rotate with respect to the secure base, with the second end of the elastic element engaged with the engaged hole of the second tube member.

8. The cover device as claimed in claim 6, with the first section of the connected element being perpendicular to the cover portion, with the second section of the connected element being perpendicular to the first section and parallel to the cover portion.

9. The cover device as claimed in claim 6, wherein the compartment has a bottom wall and a top wall, with the at least one fixed block fixed to the bottom wall; wherein while the cover member is in the second position, the first section of the connected element presses against the top wall.

10. The cover device as claimed in claim 6 wherein the outer periphery is toward the second section of the connected element and the inner periphery is toward the first section of the connected element.

11. The cover device as claimed in claim 7, wherein the restricted hole of the secure base is in a form of a polygonal hole and the limited end of the second tube member has a polygonal cross-section.

12. The cover device as claimed in claim 9, wherein the compartment has two lateral walls, a rear wall and a front wall, with the at least one fixed block surrounded between the lateral, rear and front walls.

13. The cover device as claimed in claim 12 further comprising a limited hole formed on each lateral wall of the compartment and a stepped hole axially formed on each fixed block and corresponding to the limited hole; wherein the first tube member includes an engaged end, which is defined at an end thereof, inserted into the stepped hole and engaged with the limited hole of the related lateral wall.

14. The cover device as claimed in claim 12 further comprising a gap formed at the center of the bottom wall and extending to the center of the front wall; wherein the second section of the connected element is provided at the gap and the connected element rotates with respect to the gap.

15. The cover device as claimed in claim 13 wherein the first tube member includes an engaged hole formed at another end thereof and engaged with the first end of the elastic element.

16. The cover device as claimed in claim 13, with the limited hole of each lateral wall being in a form of a polygonal hole.

* * * * *